United States Patent [19]

Lu

[11] Patent Number: 4,774,906

[45] Date of Patent: Oct. 4, 1988

[54] AUTOMATIC PLASTICS COATING DEVICE FOR ELONGATED BAMBOO POLES

[76] Inventor: Fuh-Shyong Lu, No. 8, Shih Tzyy Kang, Chung Ho T'sun, Shui Shang Hsiang, Chiayi Hsien, Taiwan

[21] Appl. No.: 746

[22] Filed: Jan. 6, 1987

[51] Int. Cl.[4] ..... B05C 3/10

[52] U.S. Cl. ..... 118/404; 425/113; 118/DIG. 11

[58] Field of Search ..... 118/404, 405, 325, DIG. 11; 425/113, 114

[56] References Cited

U.S. PATENT DOCUMENTS

| | | | |
|---|---|---|---|
| 2,185,701 | 1/1940 | Boyle | 118/405 |
| 2,708,771 | 5/1955 | Stoneback | 118/405 X |
| 2,882,555 | 4/1959 | Henning | 118/405 X |
| 3,073,441 | 1/1963 | Priaroggia et al. | 118/405 X |
| 4,177,756 | 12/1979 | Shigematsu | 118/404 |
| 4,505,222 | 3/1985 | Holt et al. | 118/405 X |

*Primary Examiner*—John P. McIntosh
*Attorney, Agent, or Firm*—Browdy and Neimark

[57] ABSTRACT

A continuously and synchronously operated plastics coating device for elongated bamboo poles or the like consists of a plastics feeding unit having a plastics injection unit planted in a perpendicular relationship to a molding member. Plastic is injected thereout in a film state through a round fissure so to coat a continuously forward-moving bamboo pole with a film of plastics. The pole is fed through one end of the assembly and moves into the film of plastics so that a continuous coating process is effected thereby.

8 Claims, 1 Drawing Sheet

AUTOMATIC PLASTICS COATING DEVICE FOR ELONGATED BAMBOO POLES

BACKGROUND OF THE INVENTION

The present invention relates to a continuously and synchronously operated plastics coating device for elongated bamboo poles or the like, which is particularly designed to eliminate conventional operational disadvantages of time-consuming and labor-demanding equipment, so to provide a device which gives off continuous plastics coating film via a peripherally-planted fissure, and through the central hole thereof a forward-moving bamboo pole is led from the other end thereof so to effect a continuous coating process.

Conventionally, a layer of plastics material is coated outside a bamboo pole for protecting the same from weathering conditions so to prolong the life of use thereof, and also beautifying the appearance of the same with a shiny and water-proof film of plastics material, and coating bamboo poles with plastic film is the most practical and effective method.

In a conventional method of coating bamboo poles, the process begins with the insertion of the elongate bamboo pole into a plastics film tube which is heated up first, then cooled down to make the plastics film contract to tightly wrap around the pole. The conventional method of effecting the coating takes labor and time to proceed with the insertion, heating and cooling of the bamboo pole. Moreover, the heat treatment of the plastics film makes the coating material vulnerable to change in its quality, causing the plastics film to lose its flexibility and easily to be damaged, and the surface thereof is also easily scorched owing to improper heating. An alternate way of heating the plastics film is available by means of hot water. This can prevent the film from being scorched, but the water absorbed by the bamboo pole can cause mold which will gradually destroy the same.

Viewing the above-cited drawbacks and disadvantages of the conventional processing of coating a bamboo pole, present invention is directed to finding an effective automatic way of coating an elongate bamboo pole, and which is operated without the conventional drawbacks.

SUMMARY OF THE INVENTION

The primary object of the present invention is to provide a continuously and synchronously operated plastics coating device for elongated bamboo poles or the like, which adopts a plastics injection molding means having a peripherally-planted round fissure out of which continuous plastics coating film is injected to coat a constantly forward-moving bamboo pole which is led, by conveyor rollers from the other end of the device, into the continuously injected coating film so to achieve a continuously and synchronously coating process.

Another object of the present invention is to provide a continuously and synchronously operated plastics coating device for elongated bamboo poles or the like, which adopts a plastics injection molding means having a peripherally-planted round fissure out of which continuous plastic coating film is injected, wherein a bamboo pole is introduced from the other end of the device and delivered forward by a plurality of conveyor rollers, and the bamboo pole is led through the center of the injected plastic film in a continuous manner so that heated film can be layed on the skin of the constantly moving elongated pole and properly attached thereon according to the contour for the same after a period of time of cooling which causes contraction.

One further object of the present invention is to provide a continuously and synchronously operated plastic coating device which makes use of plastic injection molding means to inject continuous plastic film for coating a constantly-moving bamboo pole or protection purposes so that conventional disadvantages of processing bamboo poles, such as getting the plastics film scorched, making the film fragile or damaging the bamboo later by mold caused by improper cooling process in water, are illiminated. Moreover, drawbacks such as time-consuming, and labor demanding procedures are also removed so to make economic mass-production possible by means of the device of the present invention.

DETAILED DESCRIPTION OF THE INVENTION

Figure 1:
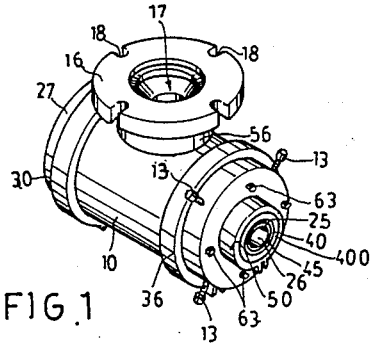
FIG. 1 is a perspective view of the synchronously operated plastics injection molding means of the present invention.
Figure 3:
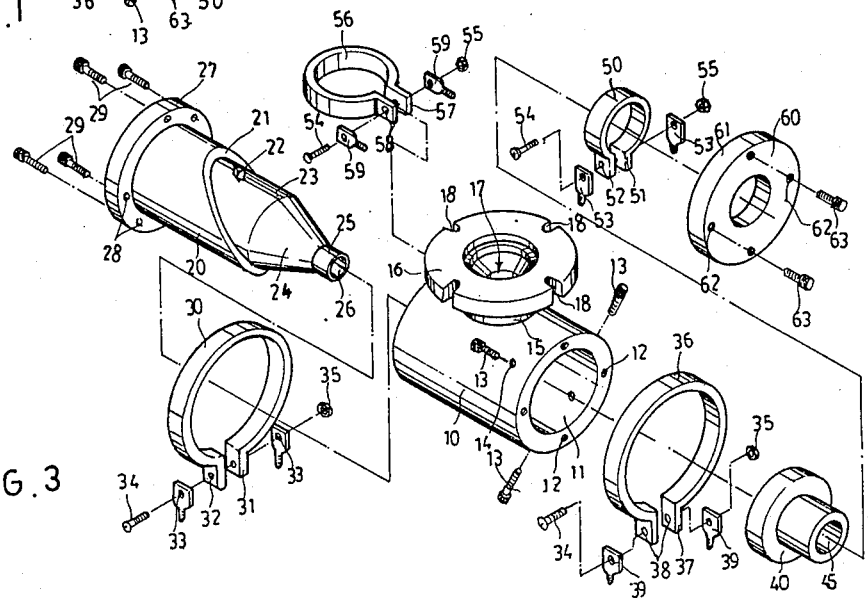
FIG. 3 is an exploded view of the assembly of the synchronously operated plastics injection molding means of the present invention.
Figure 2:
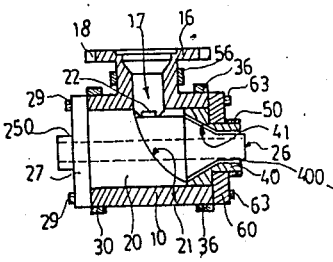
FIG. 2 is a sectional view of the synchronously operated plastic injection molding means of the present invention.

As shown in FIG. 1 through FIG. 3, the injection molding means is comprised of an embodiment or body 10, a central jacket duct 20, a central guide member 40, a fixing ring 60, and thermal elements 30, 36, 50, 56. The embodiment 10 is in a tubular form having an end-to-end duct 11 therethrough. On the transverse end wall and the lateral wall near the same end are provided with screw holes 12, 14 respectively. A connecting duct 15 is planted on the right top of tubular embodiment 10 at the middle thereof circular fixing plate 16 having a central hole 17 and a plurality of recessed portions 18 set peripherally therearound is located on top of connecting duct 15 with central hole 17 communicating with duct 11 of the embodiment 10. There is a pole-through hole 26 provided through the center of a journal end 25 set at the front thereof with a funnel-shaped member 24 joined therebehind, and . A central jacket duct 20 has an obliquely-cut end 21 connected to funnel-shaped member 24 by means of a connector duct 23 having a protruding block 22 located on the top thereof; Moreover, a flange element 27 is coupled to the end of jacket duct 20 with a plurality of screw holes placed thereon to fix the same to said embodiment 10 by bolts 29. A pole feed end 250 is located right behind flange element 27 with a pole-through hole 26 at the right center thereof. An internal tapered surface 41 is defined and extended outwardly to form a tubular end 45 in the central guide member 40 which is confinedly fixed inside embodiment 10 by means of fixing ring 60. Moreover, the thermal elements 30, 36, 50, 56 are in ring form and have an open cut with outwardly extended lugs 31, 37, 51, 57 on which screw-through holes 32, 38, 52, 58 are set for mounting the fixing screws 34, 56.

By means of said bolt 29, central jacket duct 20 is placed inside the duct 11 of tubular embodiment 10 with the protruding block 22 thereon located in conformance with the center of the central hole 17 of said circular fixing plate 16, with the obliquely-cut end 21 in fitting contact with the external edge of central hole 17. Central guide member 40 is introducted in duct 11 of tubular embodiment 10 through the other end, opposed to the one where central guide member 40 is restrainedly fixed in place by means of a fixing ring 60 as well as bolts 63. In such a manner, between the funnel-shaped member 24 and the internal tapered surface 41, a gap is defined which extends to form a round fissure 400 at the place where the journal end 25 and tubular end 45 join. Moreover, the thermal element 30 is fixed externally at the left end of tubular embodiment 10 by means of a bolt 34 and a nut 35 with a thermal line 33 attached to one lug 32 thereof. At the right end of tubular embodiment 10 is also planted a thermal element 36, and peripherally outside connecting duct 15 a thermal element 56 is also attached. A thermal element 50 is placed around the outwardly protruding journal of central guide member 40 so to effectively control the temperature of the whole molding means as well as the plastics coating film.

Figure 4:
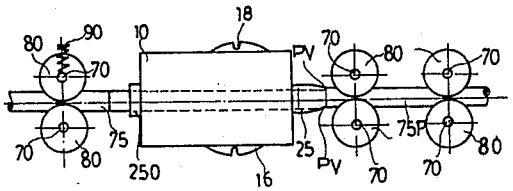
FIG. 4 is a view showing the operation of the conveyor rollers of the present invention constantly moving an elongated bamboo pole forward.
Figure 5:
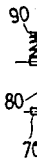
FIG. 5 is a front view of the conveyor rollers, moving a bamboo pole forward.
Figure 6:
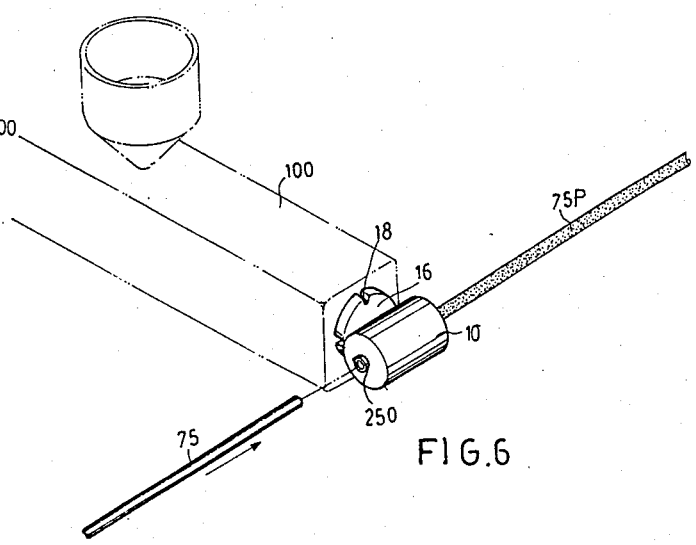
FIG. 6 is a view showing the overall structure of the assembly of the present invention.

As shown in FIG. 4 through FIG. 6, the PV-plastics material flowing out of the plastic squeezer means 100 and squeezed out via round fissure 400 is in a melted and film state, and the diameter of the circular coating film is larger than those of the fed-in bamboo pole 75 as well as the pole-through hole 26. The coating film is always kept in contact with a continuously forward moving bamboo pole, so that the constantly supplied plastics material is coated on bamboo pole 75 which is moved forward by means of rollers 80. The plastics film squeezed out of round fissure 400 is properly extended by the movement of bamboo pole 75 and surely becomes contracted to an extent due to the drop of the temperature of flexible plastics material, so as to fittedly coat the surface of pole 75 in accordance with the contour thereof. It is clearly seen now that a bamboo pole can be automatically and continuously coated with a skin of plastics film by means of the present invention, if the system is provided with an automatic feeding means, and the coating process can be carried out evenly in spite of the variety of the diameter along the length of the bamboo pole, especially at the nodes.

Summing up, the present invention is based on a plastics squeezer means 100 which is connected to a round fissure 400 of the molding means via which melting plastics is squeezed out continuously in a film form which covers the surface of a bamboo pole 75, moved at constant speed by rollers 80. The plastic film is squeezed out at the same speed of the moving bamboo so that the coating process is evenly carried out in an automatic manner. Moreover, the shape of the round fissure 400 can be changed into other geometric form in accordance with the contour of the object to be coated.

I claim:

1. A continuously and synchronously operated plastic coating device for coating bamboo poles with a plastic molding means, comprising:

a tubular body, having an open-ended duct extending therethrough and a connecting duct extendedly mounted onto a wall of said tubular body, said connecting duct having a smaller diameter than said open-ended duct and having a circular fixing plate disposed on the top thereof, said connecting duct being communicable with said open-ended duct and located perpendicularly with respect to one another;

a open-ended form central jacket duct having a front portion thereof having a smaller diameter than a rear portion thereof, said jacket having a funnel-shaped portion extendedly disposed directly behind a frontmost journal end, a connector duct defined directly behind said funnel-shaped portion, and a flange member defined at a rear end of said jacket duct;

a central guide member having an internal openended duct disposed therein and a flanged end, said internal duct being defined to have a tapered surface with one end having a larger diameter than a second end thereof;

a fixing ring having a central hole with a diameter substantially equal to that of the second end of the central guide member for fixedly securing said central guide member inside said tubular body;

four thermal elements having a flat ring form and outwardly extended fixing lugs for permitting said elements to be fixed at both ends of said tubular body and the outside of said central guide member, said connecting duct having a thermal source line connected respectively to said elements for heating up plastic molding means; and means defining a small gap formed between said funnel-shaped portion of said central jacket duct and said internal tapered surface of said central guide member, said gap extending to the second end of said central guide member to define a round fissure through which said plastic molding means is squeezed out to form continuous plastic film to coat a surface of the bamboo pole guided through said device via the central hole, located at the frontmost journal end of said central jacket duct, and said tubular body so that the bamboo pole can be continuously and synchronously coated with the plastic film thereby.

2. The device according to claim 1, wherein said tubular body comprises a plurality of screw holes symmetrically disposed at substantially equal distances from one another on two sides and the wall of said tubular body.

3. The device according to claim 1, wherein said circular fixing plate comprises a plurality of recess cuts set along the periphery thereof.

4. The device according to claim 1, wherein said connector duct comprises a protrusion block mounted thereon.

5. The device according to claim 1, wherein said flange member of said jacket duct comprises a plurality of screw holes disposed thereon for fixing said jacket duct inside said tubular body.

6. The device according to claim 1, wherein said fixing ring comprises a plurality of screw holes arranged thereon in accordance with those corresponding screw holes of said tubular body.

7. The device according to claim 1, wherein said plastic molding means comprises melted plastic.

8. A continuously and synchronously operated plastic coating device for coating bamboo poles with a plastic molding means, comprising:

a tubular body, having an open-ended duct extending therethrough and a connecting duct extendedly mounted onto a wall of said tubular body, said tubular body comprising a plurality of screw holes symmetrically disposed at substantially equal distances from one another on two sides and the wall of said tubular body, said connecting duct having a smaller diameter than said open-ended duct and having a circular fixing plate disposed on the top thereof, said circular fixing plate comprising a plurality of recess cuts set along the periphery thereof, said connecting duct being communicable with said open-ended duct and located perpendicularly with respect to one another;

a open-ended form central jacket duct having a front portion thereof having a smaller diameter than a rear portion thereof, said jacket having a funnel-shaped portion extendedly disposed directly behind a frontmost journal end, a connector duct defined directly behind said funnel-shaped portion, and a flange member defined at a rear end of said jacket duct, said connector duct comprising a protrusion block mounted thereon, said flange member of said jacket duct comprising a plurality of screw holes disposed thereon for fixing said jacket duct inside said tubular body;

a central guide member having an internal openended duct disposed therein and a flanged end, said internal duct being defined to have a tapered surface with one end having a larger diameter than a second end thereof;

a fixing ring having a central hole with a diameter substantially equal to that of the second end of the central guide member for fixedly securing said central guide member inside said tubular body, said fixing ring comprising a plurality of screw holes arranged thereon in accordance with those corresponding screw holes of said tubular body;

four thermal elements having a flat ring form and outwardly extended fixing lugs for permitting said elements to be fixed at both ends of said tubular body and the outside of said central guide member, said connecting duct having a thermal source line connected respectively to said elements for heating up plastic molding means; and means defining a small gap formed between said funnel-shaped portion of said central jacket duct and said internal tapered surface of said central guide member, said gap extending to the second end of said central guide member to define a round fissure through which said plastic molding means is squeezed out to form continuous plastic film to coat a surface of the bamboo pole guided through said device via the central hole, located at the frontmost journal end of said central jacket duct, and said tubular body so that the bamboo pole can be continuously and synchronously coated with the plastic film thereby, said plastic molding means comprising melted plastic.

* * * * *